US005990614A

United States Patent [19]

Spindt

[11] Patent Number: 5,990,614

[45] Date of Patent: Nov. 23, 1999

[54] FLAT-PANEL DISPLAY HAVING TEMPERATURE-DIFFERENCE ACCOMMODATING SPACER SYSTEM

[75] Inventor: Christopher J. Spindt, Menlo Park, Calif.

[73] Assignee: Candescent Technologies Corporation, San Jose, Calif.

[21] Appl. No.: 09/032,308

[22] Filed: Feb. 27, 1998

[51] Int. Cl.[6] ..... H01J 1/62

[52] U.S. Cl. ..... 313/495

[58] Field of Search ..... 313/422, 495, 313/292, 289

[56] References Cited

U.S. PATENT DOCUMENTS

| | | | |
|---|---|---|---|
| 4,769,575 | 9/1988 | Murata et al. | 313/495 |
| 4,900,981 | 2/1990 | Yamazaki et al. | 313/422 |
| 4,923,421 | 5/1990 | Brodie et al. | 445/24 |
| 5,083,058 | 1/1992 | Nonomura | 313/482 |
| 5,130,614 | 7/1992 | Staelin | 315/366 |
| 5,229,691 | 7/1993 | Shichao et al. | 315/366 |
| 5,528,103 | 6/1996 | Spindt et al. | 313/497 |
| 5,532,548 | 7/1996 | Spindt et al. | 313/422 |
| 5,543,683 | 8/1996 | Haven et al. | 313/461 |
| 5,578,899 | 11/1996 | Haven et al. | 313/422 |
| 5,589,731 | 12/1996 | Fahlen et al. | 313/495 |
| 5,598,056 | 1/1997 | Jin et al. | 313/495 |
| 5,614,781 | 3/1997 | Spindt | 313/422 |
| 5,650,690 | 7/1997 | Haven | 313/422 |
| 5,675,212 | 10/1997 | Schmid et al. | 313/422 |

FOREIGN PATENT DOCUMENTS

| | | |
|---|---|---|
| 0 405 262 A1 | 1/1991 | European Pat. Off. . |
| 0 523 702 A1 | 1/1993 | European Pat. Off. . |
| 0 580 244 A1 | 1/1994 | European Pat. Off. . |

OTHER PUBLICATIONS

Takahashi et al, "Back Modulation Type Flat CRT," Japances Display '92, pp. 377–380.

*Primary Examiner*—Vip Patel

*Attorney, Agent, or Firm*—Skjerven, Morrill, MacPherson, Franklin & Friel LLP; Ronald J. Meetin

[57] ABSTRACT

Image degradation that can occur in a flat-panel CRT display as a result of electron deflection caused by energy flowing through a spacer system (16) in the display is alleviated by appropriately controlling thermal, electrical, and dimensional parameters of the spacer system. In particular, spacer parameter C is selected to be low. Parameter C equals $\alpha_{AV}h^2/f\kappa_{AV}$, where $\alpha_{AV}$ is the average thermal coefficient of electrical resistivity of the spacer system, h is the height of the spacer system, $\kappa_{AV}$ is the average thermal conductivity of the spacer system, and f is the fraction of the spacer cross-sectional area to the display's active area. Parameter C is normally $6\times10^{-5}$ $m^3$/watt or less. Height h is normally 0.3 mm or more.

40 Claims, 2 Drawing Sheets

FLAT-PANEL DISPLAY HAVING TEMPERATURE-DIFFERENCE ACCOMMODATING SPACER SYSTEM

FIELD OF USE

This invention relates to flat-panel displays of the cathode-ray-tube ("CRT") type. More particularly, this invention relates to the design and fabrication of flat-panel CRT displays having spacer systems for resisting external forces, such as air pressure, exerted on the displays.

BACKGROUND

A flat-panel CRT display basically consists of an electron-emitting device and a light-emitting device. The electron-emitting device, commonly referred to as a cathode, contains electron-emissive elements that emit electrons over a wide area. The emitted electrons are directed towards light-emissive elements distributed over a corresponding area in the light-emitting device. Upon being struck by the electrons, the light-emissive elements emit light that produces an image on the viewing surface of the display.

The electron-emitting and light-emitting devices in a flat-panel CRT display are connected together, typically through a largely annular outer wall, to form a sealed enclosure having an active region in which the electrons travel from the electron-emitting device to the light-emitting device. For the display to operate efficiently, the pressure in the sealed enclosure needs to be very low, typically a high vacuum of $10^{-6}$ torr or less. The exterior-to-interior pressure differential across the display is thus typically close to 1 atm.

The electron-emitting and light-emitting devices of a flat-panel CRT display are usually quite thin. In a flat-panel CRT display of significant viewing area, e.g., at least 10 $cm^2$, the electron-emitting and light-emitting devices are normally incapable of resisting the exterior-to-interior pressure differential on their own. Accordingly, a spacer (or support) system is typically provided inside the sealed enclosure to prevent air pressure and other external forces from collapsing the display. The internal spacer system also maintains a relatively uniform spacing between the electron-emitting and light-emitting devices.

The spacer system typically consists of a group of laterally separated spacers positioned so as to not be visible on the display's viewing surface. The spacers can be shaped in various ways such as walls or posts. Regardless of how the spacers are shaped, electron flow through the display occurs in portions of the active region not occupied by the spacers.

The presence of the spacer system can adversely affect the electron flow. For example, electrons can occasionally strike the spacer system, causing it to become electrically charged. The potential field in the vicinity of the spacer system changes. Consequentially, the electron trajectories are affected, often leading to degradation in the image produced on the viewing surface. As discussed in Spindt et al, U.S. Pat. No. 5,532,548, and Schmid et al, U.S. Pat. No. 5,675,212, electrodes are typically provided along the faces of the walls of a spacer system to overcome certain adverse affects that arise from the presence of the spacer walls.

In short, spacer system design is a critical part of overall flat-panel CRT display design. The spacer system is subjected to a variety of environmental conditions. It is important that the spacer system be capable of accommodating a wide range of environmental conditions without causing image degradation.

GENERAL DISCLOSURE OF THE INVENTION

I have determined that thermal energy (heat) flowing through an internal spacer system situated between an electron-emitting device and a light-emitting device of a flat-panel CRT display can lead to image degradation. The energy flow is manifested in the form of a temperature difference across the height of the spacer system. Due to the temperature difference, the electrical resistivity of the spacer system varies along its height. With current flowing through the spacer system during display operation, the variation in electrical resistivity along the height of the spacer system causes the electric potential field along the spacer system to differ from the potential field that would exist along the spacer system in the absence of the energy flow or, equivalently, in the absence of the temperature difference.

As electrons travel from the electron-emitting device to the light-emitting device, the potential-field variation resulting from the temperature difference causes the electrons to be deflected. Some of the so-deflected electrons can move sideways sufficiently far to cause unintended features, such as lines, to appear on the display's viewing surface, thereby degrading the image presented on the viewing surface. The temperature difference can arise from heat dissipation in the electron-emitting or light-emitting device, or from extremes, such as high brightness, in the environment outside the display.

I have further determined that such image degradation can be alleviated by appropriately controlling thermal, electrical, and dimensional properties of the spacer system.

More particularly, a flat-panel display designed according to the invention contains an electron-emitting device, a light-emitting device, and a spacer (or support) system. The light-emitting device is coupled to the electron-emitting device, typically through a largely annular outer wall, to form a sealed enclosure in which electrons travel from the electron-emitting device to the light-emitting device in an active region of the display to produce an image at the exterior surface of the light-emitting device. The spacer system, situated between the electron-emitting and light-emitting devices, resists external forces exerted on the display. As measured from the electron-emitting device to the light-emitting device (or vice versa), the height of the spacer system is usually at least 0.3 mm, preferably 0.5 mm or more.

The spacer system is normally designed so that spacer parameter C is less than or equal to $6\times10^{-5}$ $m^3$/watt. Spacer parameter C is defined as $\alpha_{AV}h^2/f\kappa_{AV}$, where $\alpha_{AV}$ is the average thermal coefficient of electrical resistivity for the spacer system at approximately room temperature, h is the height of the spacer system, $\kappa_{AV}$ is the average thermal conductivity for the spacer system at approximately room temperature, and f is the fraction, as viewed generally perpendicular to the light-emitting device's exterior surface, of the average cross-sectional occupied by the spacer system within the active region to the area of the active region. Spacer parameter C is preferably less than or equal to $10^{-6}$ $m^3$/watt, more preferably less than or equal to $10^{-7}$ $m^3$/watt.

Electron deflection that results from a temperature difference across the height of the spacer system generally decreases as the value of spacer parameter C is reduced. By choosing parameter C to be $6\times10^{-5}$ $m^3$/watt or less, image degradation resulting from such electron deflection and typically manifested in the form of unintended features appearing on the display's viewing surface is greatly curtailed. When parameter C is less than or equal to $10^{-6}$ $m^3$/watt, particularly when parameter C is less than or equal to $10^{-7}$ $m^3$/watt, this form of image degradation is typically essentially eliminated for representative rates of thermal energy flowing through the spacer system.

In fabricating a flat-panel CRT display according to the invention, thermal, electrical, and dimensional parameters of the spacer system are first selected to inhibit image degradation that would otherwise occur as a result of undesired electron deflections. This normally entails making spacer parameter C low. Specifically, parameter C is chosen in accordance with the previously mentioned criteria. The electron-emitting device, the light-emitting device, and the spacer system are then assembled in accordance with each dimensional parameter, particularly fraction f, to form the display.

By designing the spacer system according to the principles of the invention, the flat-panel CRT display can readily accommodate typical rates at which thermal energy flows through the spacer system. The invention thus provides a large advance in the design and manufacture of flat-panel CRT displays.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

The present invention furnishes a technique for designing a flat-panel CRT display to reduce or avoid image degradation that could otherwise arise from a temperature difference across the height of an internal spacer system situated between the electron-emitting and light-emitting devices in the display. Electron emission in the present flat-panel CRT display typically occurs according to field-emission principles. A field-emission flat-panel CRT display designed according to the invention (often referred to as a field-emission display) can serve as a flat-panel television or a flat-panel video monitor for a personal computer, a lap-top computer, or a workstation.

In the following description, the term "electrically insulating" (or "dielectric") generally applies to materials having a resistivity greater than $10^{12}$ ohm-cm. The term "electrically non-insulating" thus refers to materials having a resistivity below $10^{12}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{12}$ ohm-cm. Similarly, the term "electrically non-conductive" refers to materials having a resistivity of at least 1 ohm-cm, and includes electrically resistive and electrically insulating materials. These categories are determined at an electric field of no more than 10 volts/$\mu$m.

Each electrically non-insulating electrode described below has a resistivity of no more than $10^5$ ohm-cm. Accordingly, electrically non-insulating electrodes can be formed with electrically conductive materials or/and electrically resistive materials of resistivity between 1 and $10^5$ ohm-cm. The resistivity of each electrically non-insulating electrode is normally no more than $10^3$ ohm-cm.

Figure 1:
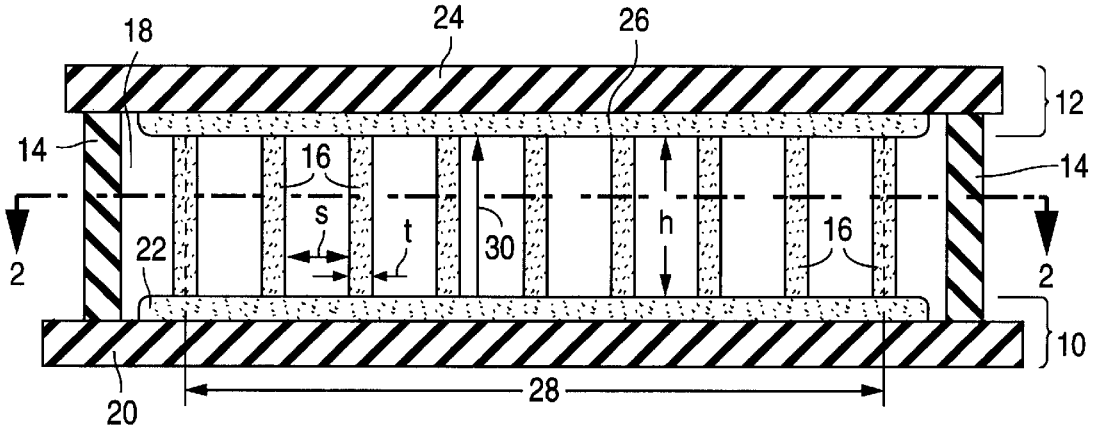
FIG. 1 is a cross-sectional side view of a flat-panel CRT display having a spacer system designed in accordance with the invention.
Figure 2:
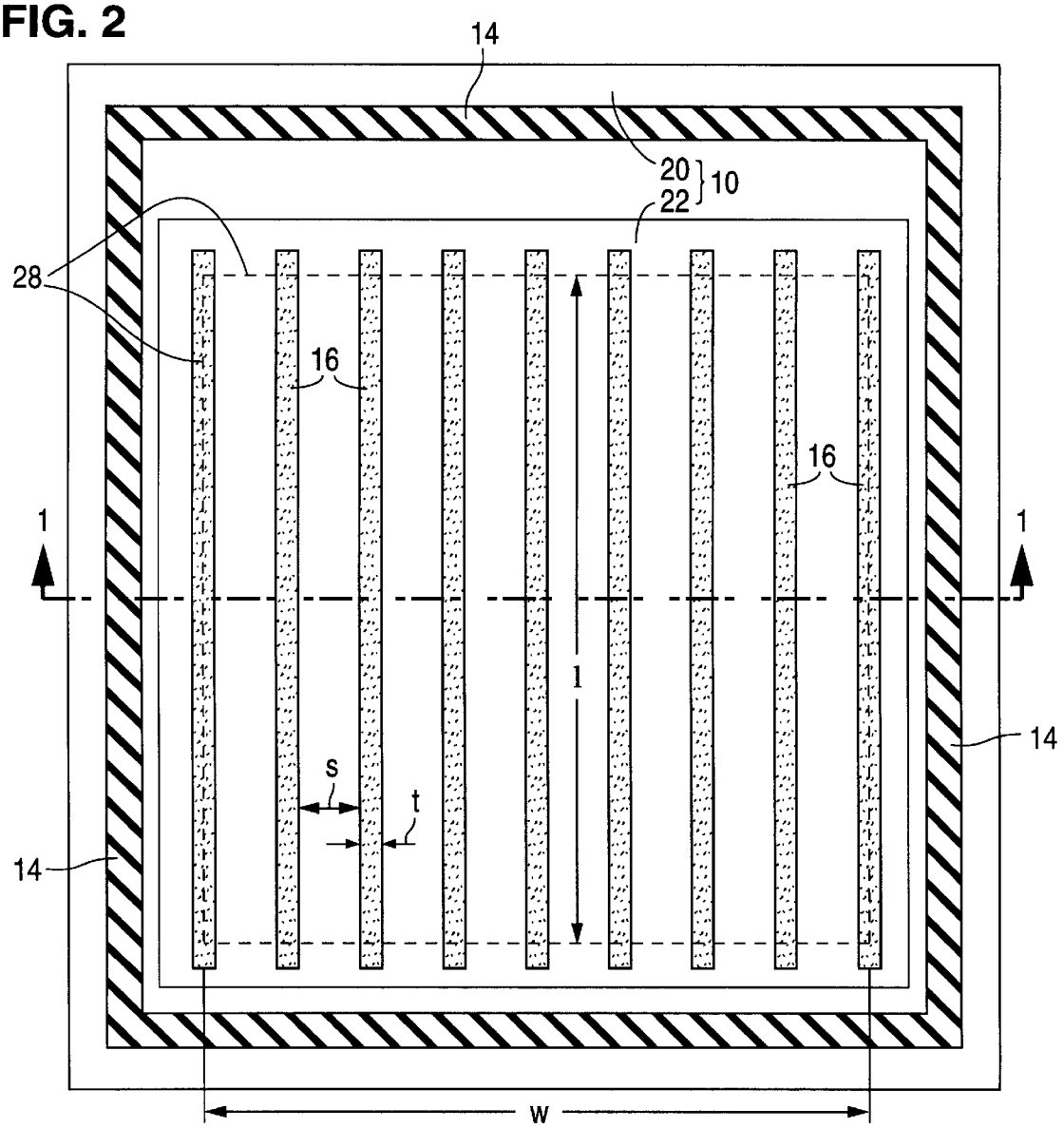
FIG. 2 is a cross-sectional plan view of the flat-panel CRT display of FIG. 1. The cross section of FIG. 1 is taken through plane 1—1 in FIG. 2. The cross section of FIG. 2 is taken through plane 2—2 in FIG. 1.

FIGS. 1 and 2 generally illustrate side and plan views of a field-emission display ("FED") designed according to the invention. The principal components of the FED of FIGS. 1 and 2 are a field-emission electron-emitting device (or field emitter) 10, a light-emitting device 12, an annular outer wall 14, and a spacer system formed with a group of generally parallel spacer walls 16. Field emitter 10 and light-emitting device 12 are connected together through outer wall 14 to form a sealed enclosure 18 maintained at a high vacuum, typically $10^{-6}$ torr or less. Spacer walls 16 are situated inside enclosure 18 between devices 10 and 12. Outer wall 14 thus laterally surrounds each spacer wall 16.

Field emitter 10 consists of a generally flat electrically insulating baseplate 20 and a group of patterned layers 22 overlying the interior surface of baseplate 20. Light-emitting device 12 consists of a generally flat transparent faceplate 24 and a group of patterned layers 26 overlying the interior surface of faceplate 24. Baseplate 20 and faceplate 24 extend substantially parallel to each other. Patterned layers 22 and patterned layers 26 can be configured in various ways. One example of the configuration for layers 22 and layers 26 is presented in FIG. 3 below.

Patterned layers 22 in field emitter 10 include a two-dimensional array of sets of field-emission electron-emissive elements (not shown in FIG. 1 or 2) which selectively emit electrons that pass through the spaces between spacer walls 16 in an active region 28 of sealed enclosure 18. The boundaries of active region 28 are generally indicated by dashed lines in FIGS. 1 and 2. The electrons emitted by each different set of electron-emissive elements are controlled (focused) so as to generally follow trajectories that terminate at a corresponding light-emissive element in a two-dimensional array of light-emissive elements (also not shown in FIG. 1 or 2) provided in patterned layers 26 of light-emitting device 12. Item 30 in FIG. 1 indicates a typical electron trajectory. Upon being struck by the impinging electrons, the light-emissive elements emit light that produce an image on the exterior (viewing) surface of faceplate 24 within an area corresponding to active region 28.

The flat-panel CRT display of FIGS. 1 and 2 can be a black-and-white or color display. Each set of electron-emissive elements and the corresponding oppositely situated light-emissive element form a pixel in the black-and-white case, or a sub-pixel in the color case. Three sub-pixels, one for each of red, blue, and green, form a pixel when the flat-panel display is a color display.

During display operation, light-emitting device 12 may be at a significantly different average temperature than field emitter 10. As indicated above, the temperature difference may arise due to factors such as heat dissipation in field emitter 10 or light-emitting device 12 and/or high external brightness, e.g., strong sunlight. Light-emitting device 12 is typically at a higher average temperature than field emitter 10. When devices 10 and 12 are at significantly different average temperatures, a significant temperature difference is normally present across the height h of spacer walls 16, the spacer-wall height being measured from field emitter 10 to light-emitting device 12 (or vice versa). Thermal energy (heat) then flows through spacer walls 16 from light-emitting device 12 to field emitter 10, or vice versa, depending on which of devices 12 and 10 is at the higher average temperature.

For instance, a temperature difference in the vicinity of 1° C. can occur across the height of spacer walls 16. Such a temperature difference can arise from a considerably greater (e.g., more than ten times greater) temperature difference between the air near the exterior surface of baseplate 20 and the air near the exterior surface of faceplate 24, most of this greater temperature difference being dropped across air boundary layers along the exterior surfaces of baseplate 20 and faceplate 24. In severe cases, the temperature difference across the height of walls 16 may reach 5° C.

Each spacer wall 16 contains electrically non-insulating, i.e., electrically conductive and/or electrically resistive, material that extends in a continuous manner along the entire height of that spacer wall 16. Patterned layers 26 of light-emitting device 12 include an anode that is maintained at a much higher voltage, typically 5,000–10,000 volts higher, than the voltages present in the electrically non-insulating layers of layers 22 in field emitter 10. As a consequence, current flows through walls 16. The direction of positive spacer-wall current flow is from light-emitting device 12 to field emitter 10. The spacer-wall current affects the electric potential field along walls 16.

The electrical resistivity of a material typically varies with temperature. The temperature difference across the height of spacer walls 16 thus typically causes the spacer-wall electrical resistivity, particularly the electrical resistivity of the electrically non-insulating spacer-wall material, to vary along the spacer-wall height. Since current flows through walls 16, the variation in the electrical resistivity of walls 16 along their height causes the potential field along walls 16 to differ from the potential field that would exist along walls 16 in the absence of a temperature difference across walls 16. If walls 16 were not designed according to the invention, the so-modified potential field along walls 16 could cause electrons emitted by field emitter 10, especially electrons emitted from electron-emissive elements near walls 16, to be deflected away from, or toward, walls 16 depending on whether the temperature of walls 16 is higher where they meet field emitter 10 or where they meet light-emitting device 12.

A temperature difference as high as 1° C. can readily occur across the height of the spacer system in a typical conventionally designed high-voltage FED spacer system, i.e., a spacer system not designed in accordance with the invention. Such a 1° C. temperature difference across a conventionally designed high-voltage FED spacer system may produce electron deflections that lead to undesired features (shapes), typically undesired lines, appearing on the display's viewing surface.

In accordance with the invention, thermal, electrical, and dimensional properties of spacer walls 16 are selected to inhibit electron deflections which would otherwise occur as a result of a temperature difference across spacer walls 16 and which, if not reduced, could cause undesired features to be visible on the exterior surface of faceplate 24. Specifically, the thermal, electrical, and dimensional properties of walls 16 are selected so that spacer thermal/dimensional parameter C is less than or equal to $6\times10^{-5}$ $m^3$/watt. Spacer parameter C is preferably less than or equal to $10^{-6}$ $m^3$/watt, more preferably less than or equal to $10^{-7}$ $m^3$/watt.

Spacer parameter C is given as:

$$C = \frac{\alpha_{AV} h^2}{f \kappa_{AV}} \tag{1}$$

where $\alpha_{AV}$ is the average thermal coefficient of electrical resistivity for spacer walls 16 at approximately room temperature, h is the average height of walls 16, $\kappa_{AV}$ is the average thermal conductivity for walls 16 at approximately room temperature, and f is the fraction, as viewed generally perpendicular to the exterior surface of faceplate 24 (the display's viewing surface), of the average cross-sectional area $A_S$ occupied by spacer walls 16 within active region 28 to the average (cross-sectional) area $A_A$ of active region 28. As indicated in FIG. 1, spacer wall height h is measured from the interior surface of electron-emitting device 10 where walls 16 contact layers 22 to the interior surface of light-emitting device 12 where walls 16 contact layers 26 (or vice versa). Spacer area fraction f is given as:

$$f = \frac{A_S}{A_A} \tag{2}$$

Reducing spacer parameter C acts to reduce electron deflection in two basic ways. Firstly reducing the $h/f\kappa_{AV}$ part of parameter C causes the temperature difference across the height of spacer walls 16 to be reduced for a given set of environmental conditions (e.g., sunlight on light-emitting device 12 or field emitter 10) that cause thermal energy to flow through walls 16 across their height. Secondly, reducing the $\alpha_{AV}h$ part of parameter C causes electron deflection to be reduced for whatever resultant, normally reduced, temperature difference occurs across the height of walls 16. By choosing the value of parameter C in the manner described above, image degradation caused by electron deflection arising from a temperature difference across the height of walls 16 is greatly reduced and, when parameter C is sufficiently small, substantially eliminated for typical high values at which thermal energy flows through walls 16.

Average height h of spacer walls 16 is normally at least 0.3 mm in the flat-panel display of FIG. 1. Preferably, height h is at least 0.5 mm. More preferably, height h is 1.0 mm or more.

Spacer walls 16 variously consist of electrically insulating, electrically resistive, and electrically conductive material. For instance, each spacer wall 16 can be constituted as an electrically non-conductive main wall (or main portion) and a patterned electrically non-insulating coating lying on one or both of the outer faces of the main wall. In particular, the non-conductive main wall consists of electrically resistive material and possibly electrically insulating material. The patterned non-conductive coating consists of electrically conductive or/and electrically resistive material. The patterned non-insulating coating for each spacer wall 16 can also extend over one or both of the opposite main wall edges where that wall 16 contacts field emitter 10 and light-emitting device 12 respectively at patterned layers 22 and patterned layers 26.

The non-conductive main walls of spacer walls 16 can be internally configured in various ways. Each main wall can be formed as one layer or as a group of laminated layers. In a typical embodiment, each main wall consists primarily of a wall-shaped substrate formed with electrically resistive material whose electrical resistivity is relatively uniform at a given temperature such as room temperature (20–25° C.) or standard temperature (0° C.). Alternatively, each main wall can be formed as an electrically insulating wall-shaped substrate covered on both substrate faces with an electrically resistive coating of relatively uniform electrical resistivity at a given temperature. The thickness of the resistive coating is typically in the vicinity of 0.01–0.1 $\mu$m. In either case, the resistive material of each main wall extends continuously along the entire height of that main wall.

Also, the resistive material of each main wall is typically covered on both faces with a thin electrically non-conductive coating that inhibits secondary emission of electrons. The secondary-emission-inhibiting coating typically consists of electrically resistive material.

Specific examples of the constituency of spacer walls 16 are presented in Spindt et al, U.S. Pat. No. 5,614,781, Spindt et al, U.S. Pat. No. 5,532,548, cited above, and Schmid et al, U.S. Pat. No. 5,675,212, also cited above. The contents of these three patents are incorporated by reference herein. The resistance that spacer walls 16 provide between field emitter 10 and light-emitting device 12 is normally $5\times10^{9}$–$5\times10^{11}$ ohm-cm$^2$, typically in the vicinity of $10^{11}$ ohm-cm$^2$, divided by active area $A_A$.

When spacer walls 16 consist substantially of a single material, average thermal coefficient of electrical resistivity $\alpha_{AV}$ and average thermal conductivity $\kappa_{AV}$ are respectively simply the thermal coefficient of electrical resistivity and the thermal conductivity of that material. When each spacer wall 16 consists of multiple materials, thermal coefficient of electrical resistivity $\alpha_{AV}$ is taken as the thermal coefficient of electrical resistivity of an otherwise identical spacer wall which is homogeneous, i.e., consists of a single material, and which exhibits the same electrical resistance at any temperature, and thus the same variation of electrical resistance with temperature, as that spacer wall 16. Similarly, thermal conductivity KAV is taken as the thermal conductivity of an otherwise identical homogeneous spacer wall which exhibits the same thermal conductance, i.e., conducts the same amount of heat for any given temperature difference, as that wall 16.

Average spacer cross-sectional area As is the inverse-weighted spacer cross-sectional area calculated from:

$$\frac{1}{A_S} = \frac{1}{h}\int_0^h \frac{dy}{A_y(y)} \tag{3}$$

where y is a distance variable in the vertical direction, i.e., perpendicular to the exterior surface of faceplate 24, and $A_y$ is the local cross-sectional area of spacer walls 16 as a function of vertical distance y as viewed perpendicular to the exterior faceplate surface. When walls 16 have a relatively constant cross-sectional area $A_{SO}$ in going from layers 22 to layers 24, applying Eq. 3 yields $A_{SO}$ as the value of spacer cross-sectional area $A_S$.

Each of spacer walls 16 occupies part of active region 28. Specifically, each wall 16 extends slightly beyond the full length of active region 28 at both ends of the wall length in the exemplary embodiment of FIGS. 1 and 2. Also, the boundaries of active region 28 pass approximately through the centerlines of the first and last of walls 16 in the embodiment of FIGS. 1 and 2. Note that additional spacers (not shown), typically spacer walls, may be situated in sealed enclosure 18 outside active region 28. If present, such additional spacers do not significantly affect the thermal considerations that lead to parameter C of Eq. 1 and are therefore not considered here.

Spacer area fraction f can be particularized in terms of dimensional and numerical characteristics of spacer walls 16. Consider the situation illustrated in FIGS. 1 and 2 in which the thickness of walls 16 is largely constant as a function of vertical distance y. Let N be the number of walls 16, including first and last walls 16, that extend through parts of active region 28. Walls 16 are normally of approximately the same average thickness t. Using Eq. 3, average cross-sectional spacer area As approximately equals (N−1)tl, where l is the length of active region 28 in the direction parallel to walls 16. Active area $A_A$ equals wl, where w is the width of active region 28 in the direction perpendicular to walls 16. Accordingly, area fraction f for the embodiment of FIGS. 1 and 2 is given approximately as:

$$f = \frac{(N-1)tl}{wl} = \frac{(N-1)t}{w} \tag{4}$$

Consecutive spacer walls 16 are typically separated by approximately the same spacing. Width w of active region 28 equals (N−1)(s+t). In the case of largely constant spacer spacing, the approximate result for the embodiment of FIGS. 1 and 2 is:

$$f = \frac{t}{s+t} \tag{5}$$

Note that Eq. 5 largely yields spacer area fraction f when all N of spacer walls 16 are width-wise fully located within active region 28. In that case, average cross-sectional spacer area $A_S$ equals Ntl. Width w of active region 28 then approximately equals N(s+t) so that active area $A_A$ approximately equals N(s+t)l. The quotient of areas $A_A$ and $A_S$, as so-modified, again produces Eq. 5.

The design and fabrication of the FED of FIGS. 1 and 2 is conducted generally in the following manner. Thermal and dimensional parameters of spacers walls 16 are first chosen to intentionally make spacer parameter C low, normally less than or equal to $6\times10^{-5}$ m$^3$/watt. Parameter C is preferably arranged to be less than or equal to $10^{-6}$ m$^3$/watt, more preferably less than or equal to $10^{-7}$ m$^3$/watt. After separately manufacturing field emitter 10, light-emitting device 12, outer wall 14, and spacer walls 16 in accordance with the chosen design, components 10, 12, 14, and 16 are assembled in accordance with the spacing mandated by the selected value of spacer area fraction f to form the FED. The assembly process is performed in such a way that the pressure in sealed enclosure 18 of the sealed display is at the desired high vacuum level.

Returning to Eq. 1, the following considerations demonstrate the importance of spacer parameter C in the design of the spacer system. By applying Ohm's law, Coulomb's law, Laplace's equation (to heat and electric field), and Newton's (force-mass) law, it can be shown that (a) the temperature difference ΔT across the height h of spacer walls 16 and (b) the amount Δx by which the trajectory of an electron moving from electron-emitting device 10 to light-emitting device 12 is altered sideways (deflected) due to thermal energy flowing through walls 16 have the following approximate dependencies:

$$\Delta T \propto \frac{hP}{f\kappa_{AV}} \tag{6}$$

$$\Delta x \propto \alpha_{AV} h \Delta T \tag{7}$$

where power density parameter P is the power (flowing) in spacer walls 16 divided by active area $A_A$. The power in walls 16 is the rate at which thermal energy flows through walls 16. Alternatively, power density parameter P is the product of spacer fraction f and the power density (power per unit cross-sectional area as viewed perpendicular to the direction of energy flow) in walls 16.

When thermal energy (or power) flows from light-emitting device 12 through spacer walls 16 into field emitter 10, the temperature where spacer walls 16 meet device 12 is higher than the temperature where walls 16 meet emitter 10. Electrons are deflected toward the nearest ones of walls 16.

This situation can, for example, correspond to positive values for power density parameter P, temperature difference ΔT, and electron deflection Δx. The reverse occurs when thermal energy flows from emitter 10 through walls 16 into device 12.

Combining Eqs. 6 and 7 yields:

$$\Delta x \propto (\alpha_{AV} h)\left(\frac{h}{f\kappa_{AV}}\right)P = CP \tag{8}$$

in which the definition of spacer parameter C from Eq. 1 has been used to achieve the right-hand part of Eq. 8.

Under certain environmental conditions (such as sunlight), power density parameter P is roughly constant. As the right-hand part of Eq. 8 indicates, the two parenthetical terms in the middle part of Eq. 8 form spacer parameter C. By decreasing the $h/f\kappa_{AV}$ part of spacer parameter C, temperature difference ΔT across spacer walls 16 is decreased (approximately) proportionately for a given value of power density parameter P in accordance with Eq. 6. At the resulting value of temperature difference ΔT, decreasing the $\alpha_{AV}h$ part of parameter C then causes deflection Δx to be decreased (approximately) proportionately in accordance with Eq. 7. For a given tolerable value of deflection Δx, parameter C needs to decrease when a change in the environmental conditions causes power density parameter P to increase so that temperature difference ΔT increases.

Eq. 8 can be modified to:

$$\Delta x = \beta CP \tag{9}$$

where β is a dimensionless parameter dependent, in part, on what contacts baseplate 20 and faceplate 24. Parameter β is usually 0.05–0.15, typically 0.11.

The maximum value of deflection Δx that can occur without causing an undesired feature, typically a line, to appear on the exterior faceplate surface due to temperature difference ΔT is typically 4 μm. The maximum value of power density parameter P accomodatable by the FED of FIGS. 1 and 2 without producing electron deflections that cause unintended features to be visible on the exterior surface of faceplate 24 is preferably at least 30 watts/m$^2$, more preferably at least 100 watts/m$^2$, even more preferably at least 300 watts/m$^2$. At the typical value of 0.11 given above for parameter β, application of Eq. 9 leads to deflection Δx being slightly less than the typical maximum acceptable Δx value of 4 μm when power density parameter P is approximately 30 watts/m$^2$ and spacer parameter C is at or slightly below $10^{-6}$ m$^3$/watt, the preferred maximum value given above for parameter C. When parameter P is approximately 100 watts/m$^2$, deflection Δx is slightly less than the typical maximum acceptable Δx value in the case where parameter C is at or slightly below $3\times10^{-7}$ m$^3$/watt. Deflection Δx is slightly less than the typical maximum acceptable Δx value when parameter P is 300 watts/m$^2$ and parameter C is at or slightly below $10^{-7}$ m$^3$/watt, the more preferred maximum C value given above.

In some cases, power density parameter may reach as much as 1000 watts/m$^2$. For such a case, spacer parameter C is set to be less than or equal to $3\times10^{-8}$ m$^3$/watt. At the typical value of parameter β, deflection Δx is then slightly less than the typical maximum acceptable Δx value of 4 μm. Alternatively, setting parameter C to be less than or equal to $3\times10^{-8}$ m$^3$/watt enables the maximum Δx value to be no more than 0.4 μm when parameter P is as much as 100 watts/m. Consequently, a reduction in parameter P by a certain factor enables deflection Δx to be reduced by approximately the same factor.

Figure 3:
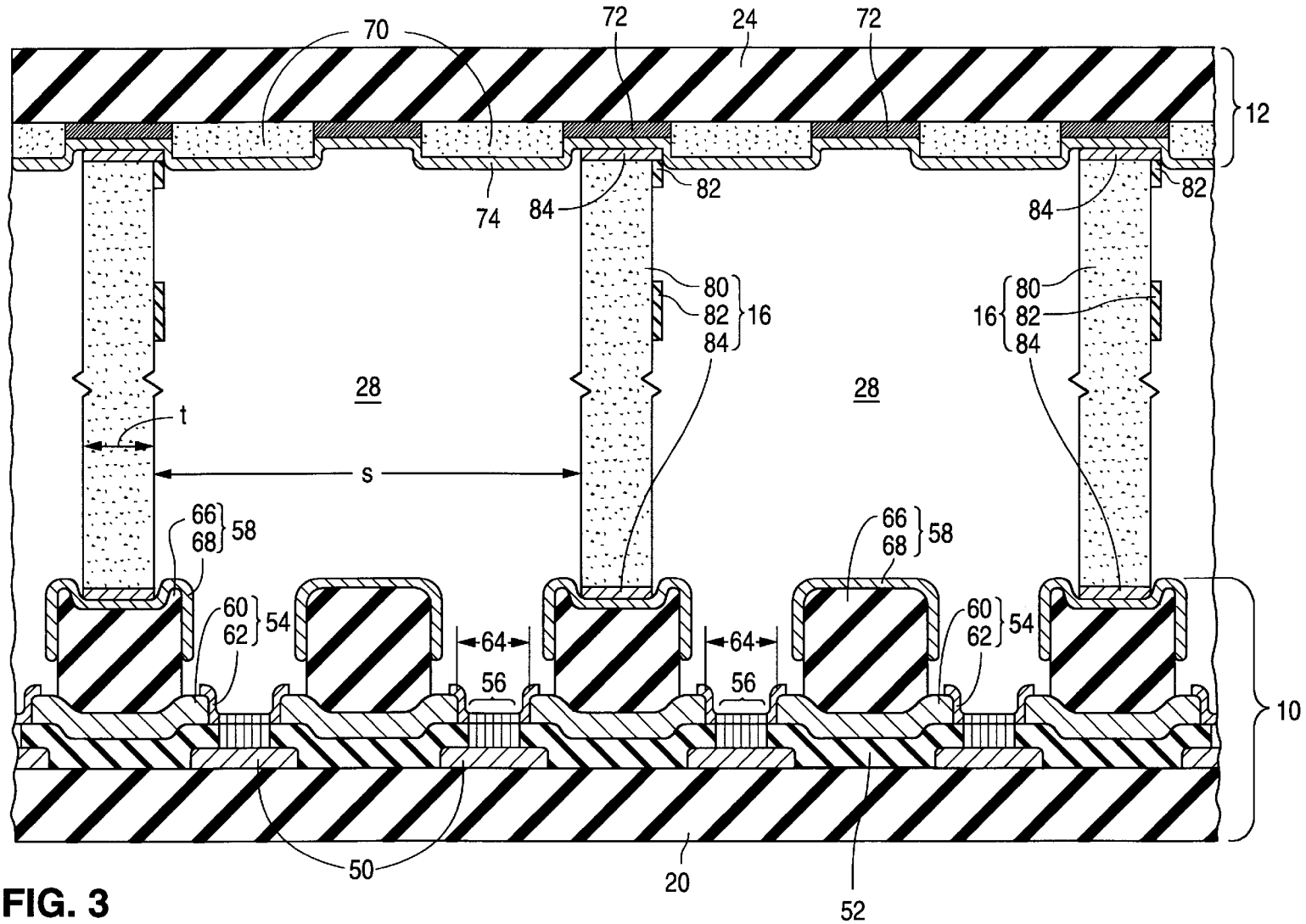
FIG. 3 is a cross-sectional side view of part of the core of an embodiment of the flat-panel CRT display of FIG. 1.

FIG. 3 depicts an embodiment of the core of the FED of FIG. 1. In the embodiment of FIG. 3, patterned layers 22 of field emitter 10 consist of a lower electrically non-insulating emitter region 50, a dielectric layer 52, a group of generally parallel control electrodes 54, a two-dimensional array of sets of field-emission electron-emissive elements 56, and a focusing system 58. Lower non-insulating region 50, which lies on the interior surface of baseplate 10, contains a group of generally parallel emitter electrodes extending in the row direction, i.e., the direction along the rows of pixels in the FED. Non-insulating region 50 normally also includes an electrically resistive layer overlying the emitters electrodes. Dielectric layer 52 overlies non-insulating region 50.

Control electrodes 54 lie on top of dielectric layer 52. Each control electrode 54 consists of (a) a main control portion 60 extending in the column direction, i.e., the direction along the columns of pixels in the FED, and (b) a set of thinner gate portions 62 adjoining main control portion 60. A corresponding set of control apertures 64 extend through each main control portion 60. Each gate portion 62 spans one of control aperture 64. In the embodiment of FIG. 3, each gate portion 62 extends partly over its main control portion 60. Alternatively, each gate portion 62 can extend partly under its control portion 60. FIG. 3 illustrates one control electrode 54, the column direction extending horizontally, parallel to the plane of figure.

Each electron-emissive element 56 is situated in an opening extending through dielectric layer 52 down to non-insulating region 50 at the location for one of the emitter electrodes, and is exposed through a corresponding opening in overlying gate portion 62. The openings through dielectric layer 52 and gate portions 62 are not shown in FIG. 3. The two-dimensional array of sets of electron-emissive elements 56 are laterally defined by the sidewalls of control apertures 64. Electron-emissive elements 56 are illustrated qualitatively in FIG. 3. In typical implementations, elements 56 are shaped as upright cones or as sharpened filaments.

Focusing system 58 is situated on control electrodes 54, particularly main control portions 60, and extends down to dielectric layer 52 in the area (not shown in FIG. 3) between apertures 54. As viewed generally perpendicular to the interior surface of the baseplate 20, focusing system 58 is configured generally in a waffle-like pattern. System 58 consists of a base focusing structure 66 and an electrically conductive focus coating 68 that lies on top of base focusing structure 66 and extends partly down its sidewalls. Focusing structure 66 is formed with electrically insulating and/or electrically resistive material. Further information on typical implementations of components 50, 52, 54, 56, and 58 is presented in Spindt et al, U.S. patent application Ser. No. 08/866,150, filed May 30, 1997, and Cleeves et al, U.S. patent application Ser. No. 08/962,230, filed Oct. 31, 1997.

Patterned layers 26 of light-emitting device 12 in the embodiment of FIG. 3 consists of a two-dimensional array of phosphor light-emissive elements 70, a "black matrix" 72, and an electrically conductive light-reflective layer 74 that serves as the anode (or collector) for the FED. Light-emitting elements 70 are situated on the interior surface of faceplate 24 respectively across from the sets of electron-emissive elements 56. Black matrix 72 overlies the interior surface of faceplate 24 in the waffle-like space between light-emissive elements 70. Metal pieces (not shown), which provide fabrication alignment tolerances, may underlie edge portions of black matrix 72. Light-reflective anode layer 74 is situated on light-emissive elements 70 and black matrix 72. Further information on typical implementations of components 70, 72, and 74 is presented in Haven et al, U.S. patent application Ser. No. 08/846,522, filed Apr. 29, 1997.

Each spacer wall 16 in the embodiment of FIG. 3 consists of a generally flat main spacer wall (or main spacer portion) 80, multiple electrically non-insulating face electrodes 82, and a pair of electrically non-insulating end (or edge) electrodes 84. Face electrodes 82, which preferably consist of electrically conductive material, can be situated on one or both of the outer faces of each main wall 80. In the embodiment of FIG. 3, face electrodes 82 are specifically situated on one of the outer faces of each main wall 80 closer to light-emitting device 12 than to field emitter 10.

End electrodes 84 of each spacer wall 16 are respectively situated on the opposing ends (or edges) of main wall 80 where that spacer wall 16 meets field emitter 10 and light-emitting device 12. Specifically, end electrodes 84 of each spacer wall 16 respectively contact (a) focus coating 68 of focusing system 58 in field emitter 10 and (b) light-reflective anode layer 74 in light-emitting device 12. The potentials applied to focus coating 68 and anode layer 74 are thereby applied to opposite edges of each spacer wall 16 by way of end electrodes 84. The potential field (or voltage distribution) at the edges of spacer walls 16 where they contact focus coating 68 can be controlled as disclosed in Spindt et al, U.S. patent application Ser. No. 09/008,129, filed Jan. 16, 1998, the contents of which are incorporated by reference herein.

FIG. 3 illustrates spacer walls 16 as extending into recessed spaces in focusing structure 58. This can arise from the forces exerted by walls 16 on focusing structure 58 during display assembly or/and from grooves formed in structure 58 prior to display assembly. In some embodiments, these recessed spaces are largely absent.

Each pair of consecutive spacer walls 16 are normally separated from one another by multiple rows of pixels. For simplicity, FIG. 3 illustrates the case in which two pixel rows separate each consecutive pair of walls 16. Normally, there are more than two, e.g., 30, pixel rows between each consecutive pair of walls 16.

In the embodiment of FIG. 3, average thermal coefficient of electrical resistivity $\alpha_{AV}$ is normally 0.001–0.02 ohm/ohm-° C., typically 0.005 ohm/ohm-° C. Average thermal conductivity $\kappa_{AV}$ is normally 10–300 watts/m-° C., typically 50 watts/m-° C. Average spacer thickness t, including the average thickness of face electrodes 82, is normally 40–100 $\mu$m, typically 50–60 $\mu$m. Spacer height h is normally 0.3–2 mm, typically 1.25 mm. Finally, spacer spacing s is normally 0.3–2 cm, typically 1 cm. Using Eq. 5, spacer area fraction f is approximately 0.005–0.006 at the specified typical values of spacer thickness t and spacer spacing s.

Using Eq. 1, spacer parameter C is approximately $3\times10^{-8}$ $m^3$/watt at the specified typical values of thermal coefficient of electrical resistivity $\alpha_{AV}$, thermal conductivity $\kappa_{AV}$, spacer height h, and spacer area fraction f. Since parameter C is less than $10^{-7}$ $m^3$/watt, image degradation due to a temperature difference across the height h of spacer walls 16 for representative values of power density parameter P in the vicinity of 300 watts/$m^2$ and for corresponding temperature difference $\Delta T$ in the vicinity of 1–2° C. is essentially eliminated with this design of spacer walls 16. In fact, such image degradation is largely eliminated with this design of walls 16 for parameter P in the vicinity of 1000 watts/$m^2$ and corresponding temperature difference $\Delta T$ in the vicinity of 5° C.

The flat-panel display of FIG. 3 operates in the following way. Anode layer 74 is maintained at a high positive potential relative to control electrodes 54 and the emitter electrodes of lower non-insulating region 50. When a suitable potential is applied between (a) a selected one of control electrodes 54 and (b) a selected one of the emitter electrodes, the so-selected gate portion 62 extracts electrons from the selected set of electron-emissive elements 56 and controls the magnitude of the resulting electron current. Desired levels of electron emission typically occur when the applied gate-to-cathode parallel plate electric field reaches 20 volt/$\mu$m at a current density of 0.1 mA/$cm^2$ as measured at light-emissive elements 70 when they are high-voltage phosphors.

Anode layer 74 attracts the extracted electrons towards the corresponding one of light-emissive elements 70. Focusing system 58, specifically focus coating 68, focuses the extracted electrons in the direction of corresponding light-emissive element 70. Face electrodes 82 control the potential field along the outside faces of spacer walls 16 and thus also serve to control the trajectories of the electrons. In addition, face electrodes 82 alleviate charge build-up that otherwise would occur on walls 16 due to electrons that strike walls 16. Finally, choosing spacer parameter C in the manner described above reduces electron deflections that would otherwise result in undesired lines appearing on the faceplate viewing surface due to a significant temperature difference across the height of walls 16.

When the electrons reach light-emitting device 12, they pass through anode layer 74 and strike corresponding light-emissive region 70, causing it to emit light visible on the exterior surface of faceplate 24. Other light-emissive elements 70 are selectively activated in the same way. Some of the light emitted by light-emissive elements 70 initially travels towards active region 28. Anode layer 74 reflects this light back towards the viewing surface to enhance the image brightness.

Directional terms such at "upper" and "lower" have been employed in describing the present invention to establish a frame of reference by which the reader can more easily understand how the various parts of the invention fit together. In actual practice, the components of a flat-panel CRT display may be situated at orientations different from that implied by the directional terms used here. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, the spacers in the spacer system can be formed as posts or as combinations of walls. The cross-section of a spacer post, as viewed along the length of the post, can be shaped in various ways such a circle, an oval, or a rectangle. As viewed along the length of a spacer consisting of a combination of walls, the spacer can be shaped as a "T", or "H", or a cross, Eqs. 1–3 and 6–9 apply to these types of spacers as well as to spacer walls 16. The spacers, when they are implemented as spacer walls, may extend only partway across the display's active area.

Field emission includes the phenomenon generally termed surface emission. The field emitter in the present flat-panel CRT display can be replaced with an electron emitter that operates according to thermionic emission or photoemission. Rather than using control electrodes to selectively extract electrons from the electron-emissive elements, the electron emitter can be provided with electrodes that selectively collect electrons from electron-emissive elements which continuously emit electrons during display operation. Various modifications and applications may thus be made by those skilled in the art without departing from the true scope and spirit of the invention as defined in the appended claims.

I claim:

1. A flat-panel display comprising:

an electron-emitting device;

a light-emitting device coupled to the electron-emitting device to form an enclosure in which electrons travel from the electron-emitting device to the light-emitting device in an active region of the display to produce an image at an exterior surface of the light-emitting device; and a spacer system situated between the electron-emitting and light-emitting devices for resisting external forces exerted on the display, the spacer system having thermal, electrical, and dimensional parameters that inhibit image degradation otherwise manifested as unintended features appearing in the image as a result of electron deflections caused by energy flowing through the spacer system.

2. A display as in claim 1 wherein the spacer system has a height, as measured from the electron-emitting device to the light-emitting device, of at least 0.3 mm.

3. A display as in claim 2 wherein the height of the spacer system is at least 0.5 mm.

4. A display as in claim 1 wherein the thermal, electrical, and dimensional parameters comprise (a) the average thermal coefficient of electrical resistivity of the spacer system at approximately room temperature, (b) the height of the spacer system as measured from the electron-emitting device to the light-emitting device, (c) the average thermal conductivity of the spacer system at approximately room temperature, and (d) the fraction, as viewed generally perpendicular to the light-emitting device's exterior surface, of the average cross-sectional area occupied by the spacer system within the active region to the area of the active region.

5. A display as in claim 1 wherein the energy flowing through the spacer system comprises thermal energy flowing between the electron-emitting and light-emitting devices.

6. A display as in claim 1 wherein the spacer system comprises a plurality of individual spacers.

7. A display as in claim 6 wherein at least one of the spacers comprises:

a main spacer portion; and a patterned electrically non-insulating coating overlying the main spacer portion.

8. A display as in claim 6 wherein the spacers comprise spacer walls.

9. A display as in claim 8 wherein each spacer wall comprises:

a main wall having a pair of opposing outer faces; and at least one electrode situated over at least one of the outer faces.

10. A display as in claim 6 wherein the unintended features comprise lines.

11. A flat-panel display comprising:

an electron-emitting device;

a light-emitting device coupled to the electron-emitting device to form an enclosure in which electrons travel from the electron-emitting device to the light-emitting device in an active region of the display to produce an image at an exterior surface of the light-emitting device; and a spacer system situated between the electron-emitting and light-emitting devices for resisting external forces exerted on the display, spacer parameter C defined as $\alpha_{AV}h^2/f\kappa_{AV}$ being less than or equal to $6\times10^{-5}$ $m^3$/watt, where $\alpha_{AV}$ is the average thermal coefficient of electrical resistivity of the spacer system at approximately room temperature, h is the height of the spacer system as measured from the electron-emitting device to the light-emitting device, $\kappa_{AV}$ is the average thermal conductivity of the spacer system at approximately room temperature, and f is the fraction, as viewed generally perpendicular to the light-emitting device's exterior surface, of the average cross-sectional area occupied by the spacer system within the active region to the area of the active region.

12. A display as in claim 11 wherein parameter C is less than or equal to $10^{-6}$ $m^3$/watt.

13. A display as in claim 11 wherein parameter C is less than or equal to $10^{-7}$ $m^3$/watt.

14. A display as in claim 11 wherein height h is at least 0.3 mm.

15. A display as in claim 11 further including a largely annular outer wall through which the light-emitting device is coupled to the electron-emitting device and which largely laterally surrounds the spacer system.

16. A display as in claim 11 wherein the spacer system comprises a plurality of individual spacers.

17. A display as in claim 16 wherein the spacers are spaced laterally apart from one another in the active region.

18. A display as in claim 16 wherein at least one of the spacers comprises:

a main spacer portion; and a patterned electrically non-insulating coating overlying the main spacer portion.

19. A display as in claim 18 wherein the main spacer portion is electrically non-conductive.

20. A display as in claim 19 wherein the main spacer portion comprises:

a substrate; and a coating overlying the substrate for inhibiting secondary emission of electrons.

21. A display as in claim 20 wherein the substrate comprises electrically resistive material of relatively uniform electrical resistivity at a given temperature.

22. A display as in claim 20 wherein the substrate comprises:

an electrically insulating core; and an electrically resistive coating overlying the core.

23. A display as in claim 18 wherein the non-insulating coating comprises electrically conductive material.

24. A display as in claim 16 wherein the spacers comprise spacer walls.

25. A display as in claim 24 wherein consecutive ones of the spacer walls are spaced approximately equidistant from each other within the active region.

26. A display as in claim 24 wherein each spacer wall comprises:

a main wall having a pair of opposing outer faces; and at least one electrode situated over at least one of the outer faces.

27. A display as in claim 26 wherein each spacer wall further includes an end electrode situated over at least one end of the main wall.

28. A display as in claim 26 wherein at least one of the spacer walls comprises a group of laminated layers.

29. A display as in claim 16 wherein the spacers comprise posts.

30. A method of fabricating a flat-panel display comprising an electron-emitting device, a light-emitting device coupled to the electron-emitting device to form an enclosure in which electrons travel from the electron-emitting device to the light-emitting device to produce an image at an exterior surface of the light-emitting device, and a spacer system situated between the electron-emitting and light-emitting devices for resisting external forces exerted on the display, the method comprising the steps of:

selecting thermal, electrical, and dimensional parameters of the spacer system to inhibit image degradation otherwise manifested as unintended features appearing in the image as a result of electron deflections caused by energy flowing through the spacer system; and assembling the electron-emitting device, the light-emitting device, and the spacer system in accordance with each dimensional parameter to form the display.

31. A method as in claim 30 wherein the spacer system comprises a plurality of individual spacers.

32. A method of fabricating a flat-panel display comprising an electron-emitting device, a light-emitting device coupled to the electron-emitting device to form an enclosure in which electrons travel from the electron-emitting device to the light-emitting device in an active region of the display to produce an image at an exterior surface of the light-emitting device, and a spacer system situated between the electron-emitting and light-emitting devices for resisting external forces exerted on the display, the method comprising the steps of:

selecting thermal, electrical, and dimensional parameters of the spacer system to intentionally make spacer parameter C low, parameter C being defined as $\alpha_{AV}h^2/f\kappa_{AV}$ where $\alpha_{AV}$ is the average thermal coefficient of electrical resistivity of the spacer system at approximately room temperature, h is the height of the spacer system as measured from the electron-emitting device to the light-emitting device, $\kappa_{AV}$ is the average thermal conductivity of the spacer system at approximately room temperature, and f is the fraction, as viewed generally perpendicular to the light-emitting device's exterior surface, of the average cross-sectional area occupied by the spacer system within the active region to the area of the active region; and assembling the electron-emitting device, the light-emitting device, and the spacer system in accordance with fraction f to form the display.

33. A method as in claim 32 wherein making parameter C low inhibits unintended features from being produced in the image due to electron deflections caused by energy flowing through the spacer system.

34. A method as in claim 32 wherein selecting the thermal, electrical, and dimensional properties of the spacer system to make parameter C progressively lower progressively inhibits unintended features from being produced in the image due to electron deflections caused by energy flowing through the spacer system.

35. A method as in claim 32 wherein the display further includes a largely annular outer wall through which the light-emitting device is coupled to the electron-emitting device, the assembling step including arranging for the outer wall to largely laterally surround the spacer system.

36. A method of fabricating a flat-panel display comprising an electron-emitting device, a light-emitting device coupled to the electron-emitting device to form an enclosure in which electrons travel from the electron-emitting device to the light-emitting device in an active region of the display to produce an image at an exterior surface of the light-emitting device, and a spacer system situated between the electron-emitting and light-emitting devices for resisting external forces exerted on the display, the method comprising the steps of:

choosing spacer parameter C defined as $\alpha_{AV}h^2/f\kappa_{AV}$ to be less than or equal to $6\times10^{-5}$ $m^3$/watt, where $\alpha_{AV}$ is the average thermal coefficient of electrical resistivity for the spacer system at approximately room temperature, h is the height of the spacer system as measured from the electron-emitting device to the light-emitting device, $\kappa_{AV}$ is the average thermal conductivity of the spacer system at approximately room temperature, and f is the fraction, as viewed generally perpendicular to the light-emitting device's exterior surface, of the average cross-sectional area occupied by the spacer system within the active region to the area of the active region; and assembling the electron-emitting device, the light-emitting device, and the spacer system in accordance with fraction f to form the display.

37. A method as in claim 36 wherein the choosing step entails choosing parameter C to be less than or equal to $10^{-6}$ $m^3$/watt.

38. A method as in claim 36 wherein the choosing step entails choosing parameter C to be less than or equal to $10^{-7}$ $m^3$/watt.

39. A method as in claim 38 wherein the display further includes a largely annular outer wall through which the light-emitting device is coupled to the electron-emitting device, the assembling step including arranging for the outer wall to largely laterally surround the spacer system.

40. A method as in claim 36 wherein the spacer system comprises a plurality of individual spacers.

* * * * *